US007079917B2

(12) United States Patent
Taguchi et al.

(10) Patent No.: US 7,079,917 B2
(45) Date of Patent: Jul. 18, 2006

(54) EMBROIDERY DATA PRODUCING DEVICE AND EMBROIDERY DATA PRODUCING CONTROL PROGRAM

(75) Inventors: Shoichi Taguchi, Nagoya (JP); Mikitoshi Suzuki, Nagoya (JP); Masahiro Mizuno, Nagoya (JP); Yukiyoshi Muto, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/090,840

(22) Filed: Mar. 25, 2005

(65) Prior Publication Data

US 2005/0228532 A1 Oct. 13, 2005

(30) Foreign Application Priority Data

Mar. 31, 2004 (JP) ..... 2004-102929

(51) Int. Cl.
*D05C 7/02* (2006.01)

(52) U.S. Cl. ..... 700/138

(58) Field of Classification Search ..... 700/138; 112/102.5, 475.19, 470.06
See application file for complete search history.

(56) References Cited

U.S. PATENT DOCUMENTS

| | | | | |
|---|---|---|---|---|
| 5,474,000 | A * | 12/1995 | Mizuno et al. | 112/102.5 |
| 5,740,057 | A * | 4/1998 | Futamura | 700/138 |
| 6,304,793 | B1 * | 10/2001 | Komiya et al. | 700/138 |
| 6,587,745 | B1 * | 7/2003 | Polden et al. | 700/138 |

FOREIGN PATENT DOCUMENTS

| | | |
|---|---|---|
| JP | A 4-156879 | 5/1992 |
| JP | A 5-76674 | 3/1993 |
| JP | A 7-255969 | 10/1995 |
| JP | B2 3106843 | 9/2000 |

* cited by examiner

*Primary Examiner*—Danny Worrell

(57) ABSTRACT

An embroidery data producing device includes an area information input unit for inputting area information indicating first and second areas to be embroidered, at least a part of the second area being overlapped inside the first area, a first setting unit for setting a first stitch type for one of the first and second areas, a second setting unit for setting a second stitch type different from the first stitch type for the other area than the area set by the first setting unit, and an embroidery data producing unit for producing first and second embroidery data based on the stitch types set by the first and second setting unit, respectively, the first embroidery data being used to embroider the first area except for its part on which the second area is overlapped, the second embroidery data being produced to embroider the second area.

23 Claims, 11 Drawing Sheets

FIRST STITCH TYPE SETTING TABLE

| Stitch type of first area | Raised/Recessed texture information | Stitch type of second area | Stitch type of third area |
|---|---|---|---|
| Tatami stitches | flat | satin stitches | Tatami stitches |
| satin stitches | flat | Tatami stitches | satin stitches |
| Tatami stitches | raised | satin stitches | satin stitches |
| satin stitches | raised | satin stitches | satin stitches |
| Tatami stitches | recessed | tatami 1 stitches | satin stitches |
| satin stitches | recessed | Tatami stitches | satin stitches |

FIG. 3

SECOND STITCH TYPE SETTING TABLE

| Stitch type | Sewing parameters |
|---|---|
| tatami stitches<br>stain stitches | Stitch forming direction (horizontal, raised to right, and raised to left)<br>thread density (2.0, 2.5, 3.0, ..., 5.0 threads/mm) |
| tatami stitches | needle drop point pitch (5.0 and 2.0 mm)<br>needle drop point deviation amount (0, 30, and 50%) |

FIG. 4

CONTROL OF PRODUCTION OF EMBROIDERY DATA

CONTROL OF CALCULATION OF NEEDLE DROP POINTS IN EACH BLOCK

E1:FIRST EMBROIDERY AREA
E2:SECOND EMBROIDERY AREA

E3:THIRD EMBROIDERY AREA

CONTROL OF PRODUCTION OF EMBROIDERY DATA

EMBROIDERY DATA PRODUCING DEVICE AND EMBROIDERY DATA PRODUCING CONTROL PROGRAM

CROSS-REFERENCE TO RELATED APPLICATION

This application claims priority from JP 2004-102929 filed Mar. 31, 2004, the entire disclosure of which is incorporated herein by reference thereto.

BACKGROUND

1. Field

The disclosure relates to an apparatus for producing embroidery data and to a program for controlling the production of the embroidery data. More particularly, the disclosure relates to a technique for arranging at least a part of a second embroidery area within a first embroidery area in such a way that the second area can be embroidered expressively with raised or recessed texture.

2. Description of Related Art

When an area within a set outline (hereinafter referred to as the base area) is filled with stitches, embroidery stitches may be formed such that a separate design pattern is expressed within the base area. In the past, various kinds of apparatuses have been proposed to produce embroidery data for forming such embroidery stitches. This embroidery technique of forming a separate design pattern within a base area filled with stitches is known as "stamp embroidery", while the design pattern expressed within the base area is known as a "stamp pattern".

For example, an embroidery data producing device as described in JP-B-7-4456 is available as a technique for producing embroidery data to perform such stamp embroidery. This embroidery data producing device is so designed that when embroidery stitches are formed in an embroidery area of the base area, the intersections of embroidery stitches in the base area and the outline of an embroidery area with a stamp pattern are set as needle drop points. This device is designed such that the needle is made to drop at every point on the outline of the inner stamp pattern. A different pattern is formed within the base area.

In the embroidery data producing device described in the above-cited Patent Publication, a stamp pattern is represented simply by setting needle drop points on the outline of the stamp pattern inside the base area to be embroidered with satin stitches. Consequently, the base area and the inside of the stamp pattern do not differ in stitch type. Therefore, it is impossible to make the stamp design pattern (corresponding to the second area to be embroidered) more conspicuous than the base area (corresponding to the first area to be embroidered). Hence, there is the problem that the stamp pattern cannot be expressed effectively.

SUMMARY

Therefore, an object of the disclosure is to provide an embroidery data producing device which can make the stitches in a second embroidery area more conspicuous than the stitches in a first embroidery area and which can effectively express the second embroidery area. It is another object of the disclosure to provide a program for controlling the production of embroidery data.

An embroidery data producing device according to the disclosure is intended to produce embroidery data for embroidering by an embroidery sewing machine and has area information input means for inputting area information indicating first and second areas to be embroidered. At least a part of the second area is overlapped inside the first area. The device further includes first setting means for setting a first stitch type for one of the first and second areas. The device further includes second setting means for setting a second stitch type different from the first stitch type for the other area than the area set by the first setting means. The apparatus further includes embroidery data producing means for producing first and second embroidery data based on the stitch types set by the first and second setting means, respectively. The first embroidery data is produced to embroider the first area except for its part on which the second area is overlapped. The second embroidery data is produced to embroider the second area.

According to the embroidery data producing device of the construction described above, the stitches formed in the second embroidery area are different in type from the stitches formed in the first embroidery area. Therefore, the stitches in the second embroidery area can be expressed more conspicuously than the stitches in the first embroidery area.

A program stored in a computer-readable medium for controlling production of embroidery data in accordance with the disclosure is used to cause a computer equipped in an embroidery data producing device to provide control of production of the embroidery data. The data producing device produces embroidery data for performing embroidery by an embroidery sewing machine. The program includes an area information input routine for inputting area information indicating first and second areas to be embroidered. At least a part of the second area is overlapped inside the first area. The program further includes a first setting routine for reading in data to be used to set a first stitch type for one of the first and second areas. The program further includes a second setting routine for reading in data to be used to set a second stitch type different from the first stitch type for the other area than the area set by the first setting means. The program further includes an embroidery data production routine for producing first and second embroidery data based on the stitch types set by the first and second setting routines. The first embroidery data is produced to embroider the first area except for its part on which the second area is overlapped. The second embroidery data is produced to embroider the second area.

BRIEF DESCRIPTION OF THE DRAWINGS

Other objects, features and advantages will become clear upon reviewing the following description of the embodiment with reference to the accompanying drawings, in which:

FIG. 3 is a diagram showing set data in a first stitch type setting table;

FIG. 4 is a diagram showing set data in a second stitch type setting table;

DETAILED DESCRIPTION OF EXEMPLARY EMBODIMENT

Figure 1:
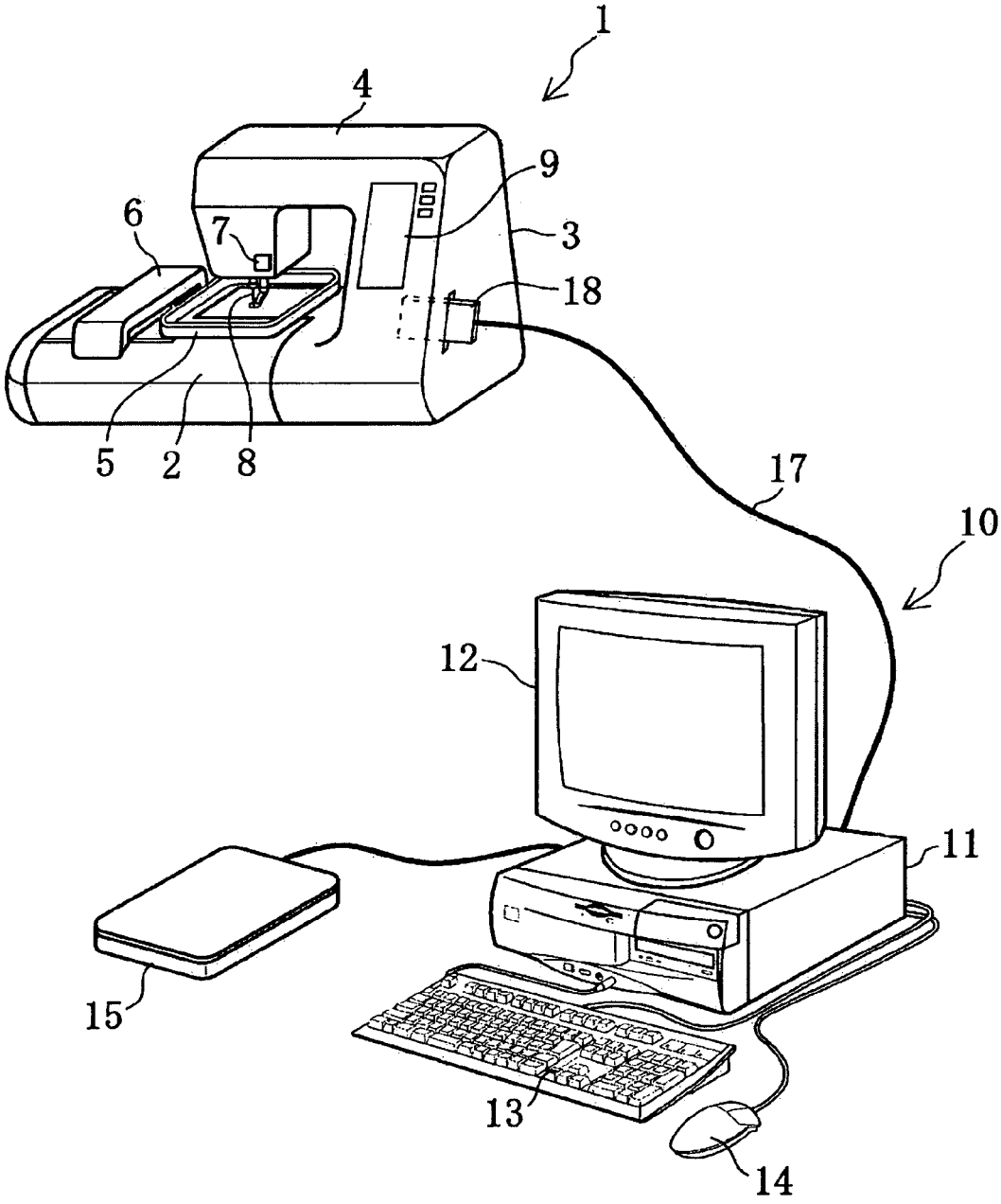
FIG. 1 is a perspective view of an embroidery data producing device and an embroidery sewing machine according to one embodiment.

Embodiments are hereinafter described with reference to the accompanying drawings. An embroidery sewing machine 1 capable of performing embroidery is first described briefly with reference to FIG. 1. This sewing machine 1 is similar to an ordinary electronic control sewing machine for domestic use. The body of the machine 1 has a bed portion 2, a column 3, and an arm 4. A loop-taker (not shown) is mounted on the bed portion 2. A frame drive mechanism 6 for moving a cloth holding frame 5 in the X- and Y-directions is mounted also on the bed portion 2.

A switch 7 for issuing an instruction to start sewing is mounted on the arm 4. A main shaft (not shown) to be driven by a sewing machine motor is disposed in the arm 4. A needle bar and a needle 8 at the lower end of the needle bar are driven up and down by rotation of the main shaft via a needle bar drive mechanism.

A liquid crystal display 9 capable of providing a color display is mounted in the column 3. A connector code 17 is connected with the controller 20 of an embroidery data producing device 10 (described later) and has a connector 18 connected with the column 3. Therefore, on receiving embroidery data sent from the data producing device 10, an X direction drive motor and a Y direction drive motor mounted in the frame drive mechanism 6 are controllably driven based on the embroidery data. The cloth holding frame 5 connected to the frame drive mechanism 6 is moved in the X- and Y-directions independently to form an embroidery pattern on cloth W such as a handkerchief or blouse held to the cloth holding frame 5.

The embroidery data producing device 10 is made up of a personal computer 11, a display device 12, a keyboard 13, a mouse 14, an image scanner 15, and other components. Area data is produced based on an embroidery area read by the scanner 15 and on data about coordinates in an embroidery area plotted and set via a mouse pointer on the display device 12 by operation of the mouse 14. Based on the area data, stitch data for issuing instructions about relative amounts of movement of the cloth holding frame 5 in the X- and Y-directions, respectively, is produced by an embroidery data producing control program (described later).

Figure 2:
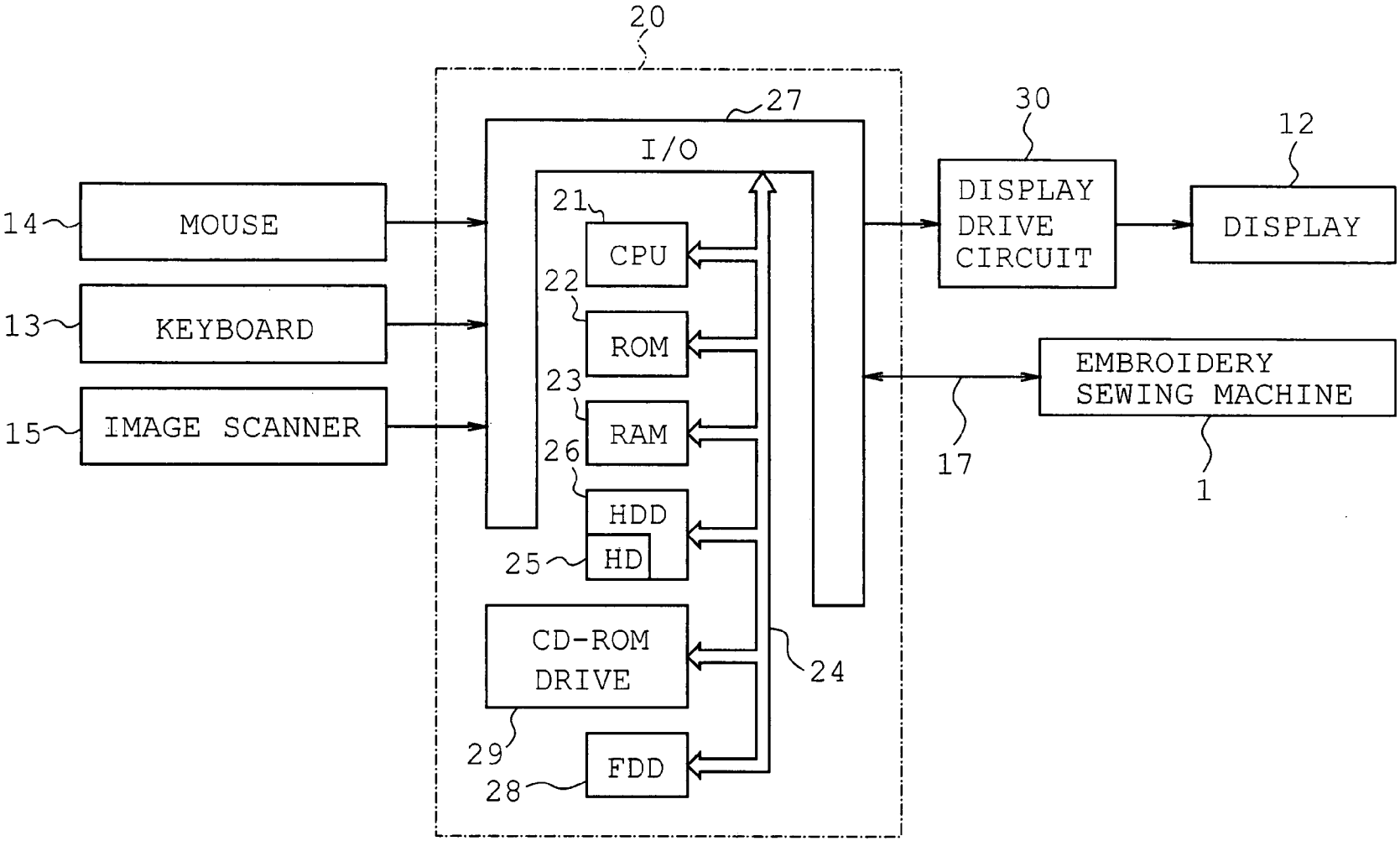
FIG. 2 is a block diagram of the control system of the embroidery data producing device.

As shown in FIG. 2, the personal computer 11 is equipped with the controller 20 for controlling the whole control process regarding production of embroidery data. The controller 20 includes a microcomputer, a hard disk drive (HDD) 26, and an input/output interface 27. The microcomputer includes a CPU 21, a ROM 22, a RAM 23, and a bus 24 connecting them. The hard disk drive 26 is connected to the bus 24 and has a hard disk (HD) 25.

A flexible disk drive (FDD) 28 and a CD-ROM drive 29 are also connected to the bus 24. The keyboard 13, mouse 14, and image scanner 15 are connected to the input/output interface 27. A display drive circuit 30 for driving the display device 12 is also connected to the interface 27. Furthermore, the embroidery sewing machine 1 is connected to the interface 27 via the connector code 17.

An activation program for activating the personal computer when the power supply of the computer is turned ON is stored in the ROM 22. On the other hand, an OS (operating system), various drivers for activating the display device 12, keyboard 13, mouse 14, image scanner 15, and so on, and application programs are stored in the hard disk 25. Furthermore, an area division control program for dividing the embroidery area into blocks or not dividing the area, an embroidery data producing control program (described later), data indicating ancillary stitch type setting tables (which will be described by referring to FIGS. 3–6), and various control programs are also stored in the hard disk 25.

In this case, as shown in FIG. 3, a first stitch type setting table is previously stored in the hard disk 25. In this table, a stitch type (tatami or satin) in the first embroidery area, raised/recessed texture information (flat, raised, or recessed) for specifying whether an embroidery to be formed in the second area is raised or recessed relative to the stitches to be formed in the first area, and a stitch type in the second area are made to correspond to each other. The stitch type of the second area is automatically set depending on the stitch type of the first area and on the raised/recessed texture information.

Furthermore, a second stitch type setting table as shown in FIG. 4 is previously stored in the hard disk 25. In this table, sewing parameters (stitch forming direction and thread density) common to tatami stitches and satin stitches and sewing parameters (needle drop point pitch and needle drop point deviation amount) applied only to tatami stitches are set. The needle drop point pitch is the interval between the needle drop points for performing tatami stitches. The needle drop point deviation amount is the amount of deviation respecting a stitch forming direction of needle drop points in a continuous stitch line.

The various programs, parameters, and so on stored in the hard disk 25 are read into the RAM 23 and executed or processed. Furthermore, embroidery area data entered and set via the mouse pointer, embroidery area data read and produced by the image scanner 15, embroidery data (stitch data) produced based on the embroidery area data produced via the display device 12, and other data are stored in the RAM 23 and hard disk 25.

Figure 5:
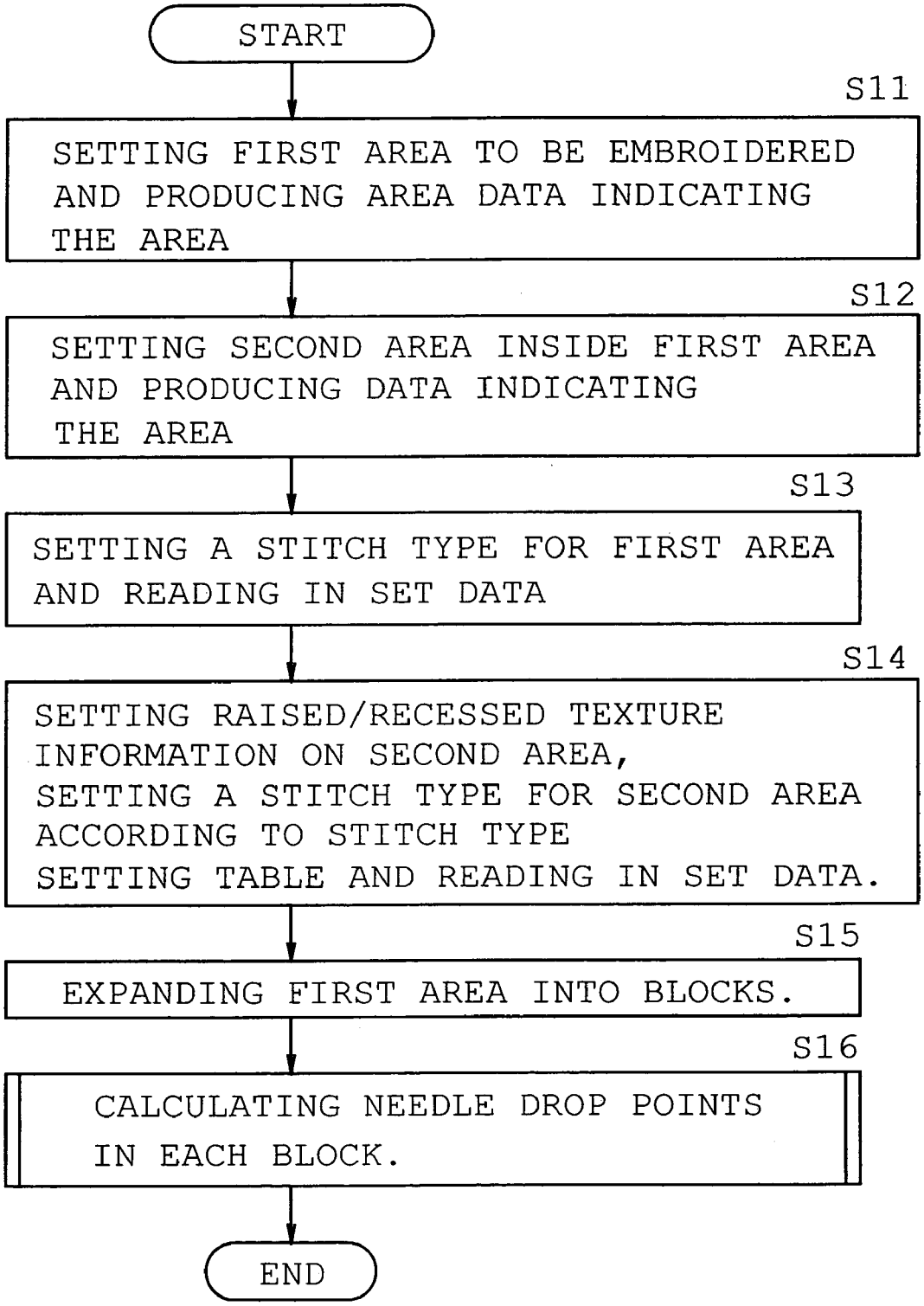
FIG. 5 is a flowchart illustrating a sequence of control operations for producing embroidery data.
Figure 6:
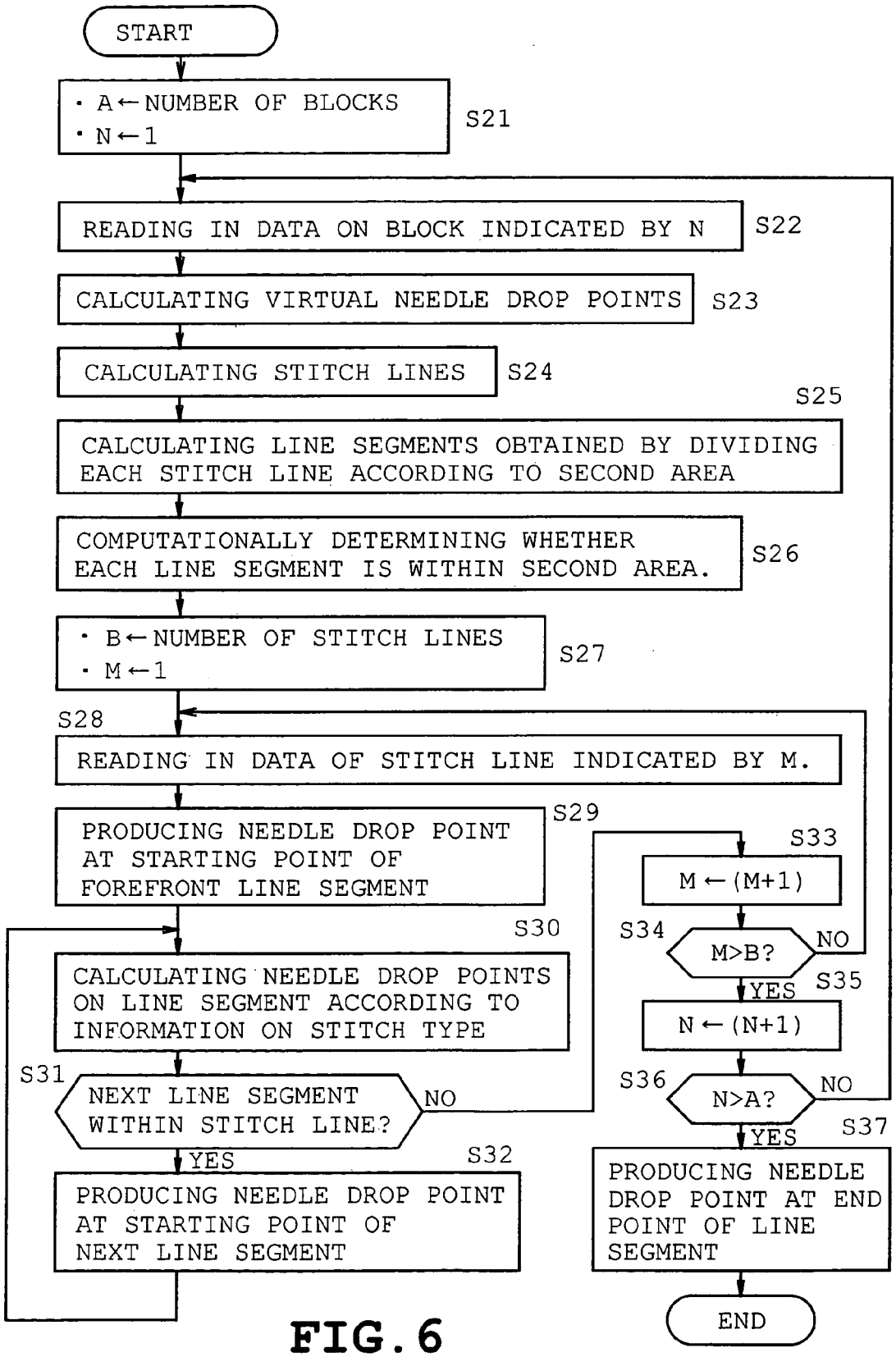
FIG. 6 is a flowchart illustrating control of calculations of stitch drop points in a block.

A control program for controlling the manner in which embroidery data is produced based on the entered first and second embroidery areas is described by referring to FIGS. 5 and 6. In the figures, each symbol Si (i=11, 12, 13, and so forth) indicates each process step. A rectangular, first embroidery area E1 shown in FIG. 7 corresponds to one area to be embroidered. A heart-shaped second embroidery area E2 corresponds to the other area to be embroidered.

Figure 7:
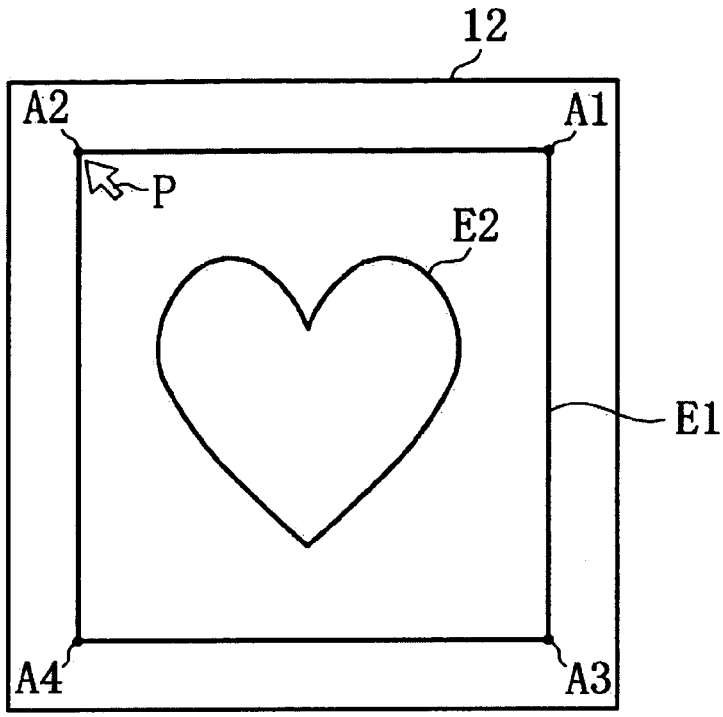
FIG. 7 represents an example of display on a display device on which first and second embroidery areas are set.

When a given key (e.g., embroidery data producing key) on the keyboard 13 is operated, this control operation is started. First, as shown in FIG. 7, the mouse 14 is operated on the display device 12 to click the mouse pointer P for making plots. In this way, if the first embroidery area E1 (A1 to A4) that is a square base area is set, area data (data about an outline) about the first area E1 is produced (S11). Then, the mouse 14 is similarly operated to click the mouse pointer P for making plots. Thus, a second embroidery area E2 that is a heart-shaped stamp pattern is set within the first area E1. Area data (data about an outline) about the second area E2 is produced (S12).

Subsequently, an operator's operation on a stitch type setting window (not shown) displayed on the display device 12 sets a stitch type (e.g., satin stitches) in sewing the first area E1. Based on the second stitch type setting table shown in FIG. 4, the operator sets sewing parameters (e.g., stitch forming direction "horizontal" and thread density "4.0 threads/mm") under the stitch type set as described above. These set data items are read in (S13).

The parameters regarding the stitch type are not limited to given values previously stored as in the example shown in FIG. 4. It may also be possible that the operator can arbitrarily select values from given ranges of numerical values. For example, the "stitch forming direction" may be a range of directional angles "0° to 359°". The "thread density" may be a range of 1 to 7 threads/mm. Furthermore, the "thread drop point deviation amount" may be a range of "0 to 99%". The operator may arbitrarily select values from these ranges of values.

Control then goes to step S14, where the operator sets raised/recessed texture information indicating whether the pattern sewn in this second area E2 has texture raised or recessed relative to the pattern sewn in the first area E1. Then, based on the contents of the first stitch type setting table, the stitch type (e.g., tatami stitches) of the second embroidery area E2 is automatically set. Concurrently with this, the sewing parameters under this stitch type are automatically set based on the second stitch type setting table. These set data items are read in.

More specifically, it is assumed that the operator has set the stitch type of the first embroidery area E1 to "satin stitches" in the above-described step S13 and that the operator has set the raised/recessed texture information to "recessed" texture in step S14. Then, in order to make the pattern sewn on the second embroidery area E2 have texture recessed relative to the pattern sewn in the first area E1 embroidered with satin stitches, the stitch type of the second area E2 is automatically set to "tatami stitches".

Generally, when an area is sewn, a tatami stitching process needs more needle drop points than a satin stitching process. Therefore, the tatami stitched area can be made to have texture recessed relative to the surrounding satin stitched area, by introducing the tatami stitched area into the satin stitched area.

Then, based on the data about the stitch forming direction set in the step S13, the first embroidery area E1 is expanded into blocks or treated as one block (S15). Processing (see FIG. 6) for calculating needle drop points in each block produced is executed (S16). When this processing is started, the number of blocks produced in the step S15 is set into a block number counter A. An initial value of "1" is set into a pointer N (S21 of FIG. 6).

Figure 8:
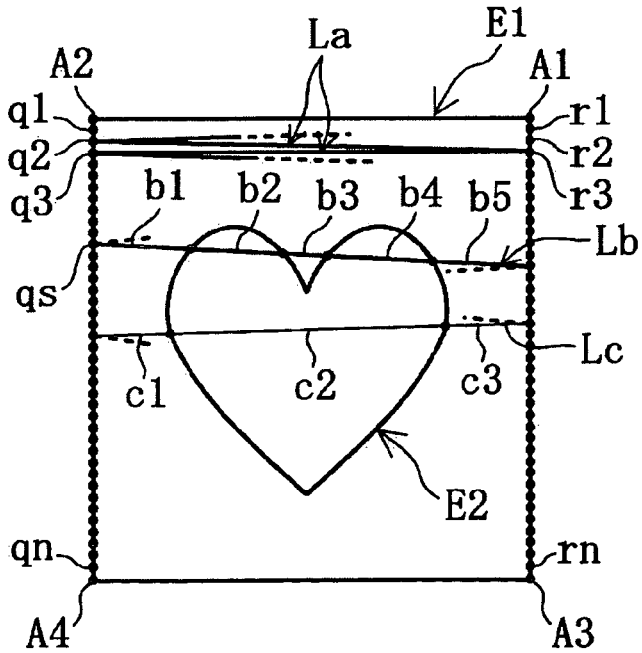
FIG. 8 illustrates a method of calculationally finding needle drop points from stitch lines.

Data about the block specified by the pointer N is read in (S22). Based on the block data (outline data) about the first embroidery area E1 (rectangular figure connecting A1-A4 shown in FIG. 7) and on the thread density data set in the step S13, virtual needle drop points for calculating each stitch line L (described later) are computed (S23). For example, as shown in FIG. 8, plural virtual needle drop points q1, q2, q3, . . . , qn are found for the sides A2–A4 of the first embroidery area E1 (A1–A4). Plural virtual needle drop points r1, r2, r3, . . . , rn are found for the sides A1–A3.

Then, all stitch lines L1, L2, L3, . . . , Ln (only stitch lines La, Lb, and Lc are shown in FIG. 8) alternately connecting the virtual needle drop points q1, q2, q3, . . . , qn and the virtual needle drop points r1, r2, r3, . . . , rn are calculated (S24). Line segments are calculated by dividing each stitch line L based on points at which the outline of the second embroidery area E2 intersects with each stitch line L (S25).

In the description provided below, even each stitch line L (stitch line La shown in FIG. 8) not intersecting with the outline of the second embroidery area E2 is similarly treaded as line segment L. Each line segment is judged whether it belongs to the inside of the second embroidery area E2. If the segment belongs to the inside of the area, data indicating that the line segment is within the area is stored ancillarily to the line segment (S26).

Then, the number of stitch lines L found in the step S24 is set into a line number counter B. An initial value of "1" is set into a pointer M (S27). Then, data about the stitch line L specified by the pointer M is read in (S28). The starting point of the stitch line L (that is also a line segment) (i.e., a point on the outer periphery of the first embroidery area E1) is calculated as a needle drop point (S29). Then, needle drop points to be formed on the line segment L are calculated, depending on whether the line segment L belongs to the first embroidery area E1 or the second embroidery area E2 and according to information about the stitch type set for the each area (S30).

The case shown in FIG. 8 is taken as an example. The stitch line La (i.e., line segment La) connects the virtual needle drop points q2 and r3. The virtual needle drop point q2 that is the starting point of the stitch line La is computed as a needle drop point (S29). Then, needle drop points on the line segment La are calculated based on the stitch type (including the sewing parameters) of the first embroidery area E1 set in the step S13, because the line segment La is a stitch line belonging to the first area E1. In the example shown in FIG. 8, the stitch type set in the step S13 is "satin stitches". Therefore, any needle drop points on the line segment La are not calculated except for the starting point.

Then, a decision is made as to whether there exists a next line segment within the stitch line L specified by the pointer M (S31). If the decision is affirmative (YES in S31), the starting point of the next line segment is calculated as a needle drop point (S32). Thereafter, the process steps of S30 to S31 are repeatedly carried out. On the other hand, if the decision of the step S31 is negative (NO in S31), the value of the pointer M is incremented by 1 (S33). Then, if the incremented value of the pointer M is smaller than the value of the line number counter B (NO in S34), the process steps of S28 to S34 are repeatedly carried out for the stitch line L specified by the incremented pointer M.

The disclosure is described in further detail while taking the case of FIG. 8 as an example. With respect to the aforementioned stitch line La, there exists no next line segment within the stitch line La (NO in S31). Therefore, the pointer M is incremented in step S33. The process steps of S28 to S34 are carried out for the stitch line L specified by the pointer M. In a case where the stitch line indicated by the pointer M is the stitch line Lb shown in FIG. 8, the virtual needle drop point qs that is the starting point of the line segment b1 within the line segment Lb is calculated as a needle drop point in step S29.

Then, in Step 30, based on the stitch type (including the sewing parameters) set for the first embroidery area E1 to which the line segment b1 belongs, needle drop points to be formed on the line segment b1 are calculated. In this case, the set stitch type is "satin stitches". Therefore, it follows that any needle drop points on the line segment b1 is not calculated except for the starting point. There exists the line segment b2 following the line segment b1 within the line segment Lb (YES in S31). Therefore, the starting point of the line segment b2 (i.e., the intersection of the line segment b2 and the outline of the second embroidery area E2) is computed as a needle drop point (S32).

Control returns to step S30, where needle drop points to be formed on the line segment b2 are calculated. In this case, the line segment b2 belongs to the second embroidery area E2 and so needle drop points are calculated based on the stitch type (including the sewing parameters) set for the second area E2 in step S14. Specifically, the stitch type set for the second area E2 is "tatami stitches" Therefore needle drop points for making tatami stitches on the line segment b2 are calculated based on the set sewing parameters.

Subsequently, the process steps of S30 to S32 are repeatedly carried out for the line segments b3 and b4 on the stitch line Lb. The process step of S30 is executed for the line segment b5. Since any line segment next to the line segment b5 does not exist on the stitch line Lb (NO in S31), the pointer M is incremented in step S33. With respect to the stitch line L that follows the stitch line Lb, the process steps of S28 to S35 are repeatedly carried out.

The above-described processing is repeated. If the value of the pointer M becomes larger than the value of the line number counter B (YES in S34), the value of the pointer N is incremented by 1 (S35). Then, the incremented value of the pointer N is compared with the value of the block number counter A (S36). If the value of the pointer N is not greater than the value of the block number counter A (NO in S36), the process steps of the S22 to S36 are repeatedly carried out for the block indicated by the pointer N. On the other hand, if the value of the pointer N becomes greater than the value of the block number counter A (YES in S36), the end point of the line segment treated at this time is calculated as a needle drop point (S37). This sequence of operations is ended.

In this way, first embroidery data and second embroidery data are produced. The first embroidery data is data about needle drops for performing embroidery in the first area E1 except for its part on which the second area E2 is overlapped. The second embroidery data is data about needle drops for performing embroidery on the second area E2. Consequently, embroidery data is produced which is used to embroider the second area E2 within the first area E1 with a stitch type different from the stitch type of the first area E1 that provides a basis. In other words, data about embroidery consisting of a combination of different stitch types is produced to perform a sequence of sewing operations, for sewing a line of embroidery.

For example, as shown in FIG. 8, with respect to the stitch line La on the forefront side, the second embroidery area E2 does not overlap it and so no division is done. Since the stitch type set for the first embroidery area E1 is "satin stitches", needle drop points are formed only at the starting point and end point (i.e., the starting point of the stitch line next to the stitch line La) of the stitch line La.

However, the stitch line Lb crossing the second embroidery area E2 is divided into five line segments b1 to b5. With respect to the line segments b1, b3, and b5 belonging to the first embroidery area E1, the stitch type set for the first area E1 is "satin stitches" and so needle drop points are formed at their starting and end points, i.e., on the outer periphery of the first embroidery area E1 and on the outline of the second embroidery area E2. On the other hand, with respect to the line segments b2 and b4 belonging to the second embroidery area E2, needle drop points for tatami stitches based on automatically set needle drop point pitch and needle drop point deviation amount are formed.

Similarly, the stitch line Lc crossing the second embroidery area E2 is divided into three line segments c1 to c3. With respect to the line segments c1 and c3 belonging to the first embroidery area E1, needle drop points are formed on their starting and end points, i.e., on the outer periphery of the first embroidery area E1 and on the outline of the second embroidery area E2. With respect to the line segment c2 belonging to the second embroidery area E2, needle drop points for tatami stitches based on automatically set needle drop point pitch and needle drop point deviation amount are formed.

Figure 9:
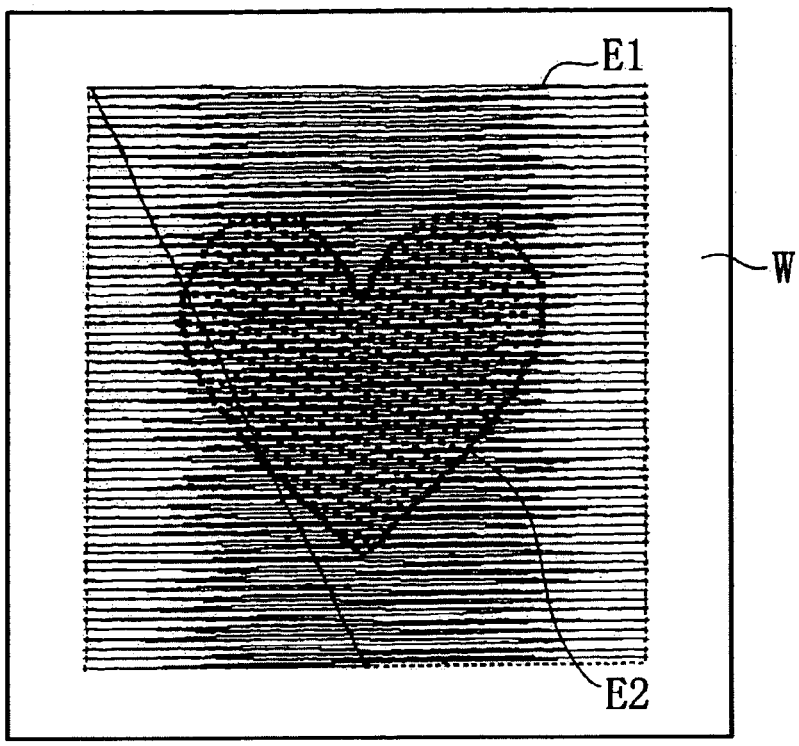
FIG. 9 is a plan view of cloth embroidered such that a stamp pattern "heart" is recessed relative to a base area.

Therefore, first embroidery data and second embroidery data are produced. The first embroidery data is used to perform embroidery in the first area E1 except for its part on which the heart-shaped second embroidery area E2 is overlapped. The second embroidery data is used to perform embroidery on the heart-shaped second embroidery area E2. When the cloth W held to the cloth holding frame 5 is sewn by the sewing machine 1 using the first and second embroidery data, satin stitches are formed on the first area E1 that is a base area except for its part on which the second area E2 is overlapped, and tatami stitches are automatically formed on the second area E2 overlapping the first area E1 as shown in FIG. 9. This can simplify the operation to set the stitch type of stitches to be formed on the second area E2. Furthermore, the stitch type of the second area E2 is different from the stitch type of the first area E1. Therefore, the second embroidery area E2 can be expressed more conspicuously than the first embroidery area E1 in a three-dimensional manner.

Additionally, the embroidery data are produced in such a way that the stitch forming direction used when embroidering the first area E1 is the same as the stitch forming direction used when embroidering the second area E2. Therefore, these two areas E1 and E2 can be embroidered continuously in one operation. Hence, the sewing processing can be hastened.

Moreover, the form of the second embroidery area E2 can be expressed more conspicuously than the first embroidery area E1 because the embroidery data to form needle drop points on the outline of the second area E2 is produced under the control of the block shown in FIG. 6 for calculating needle drop points.

Figure 10:
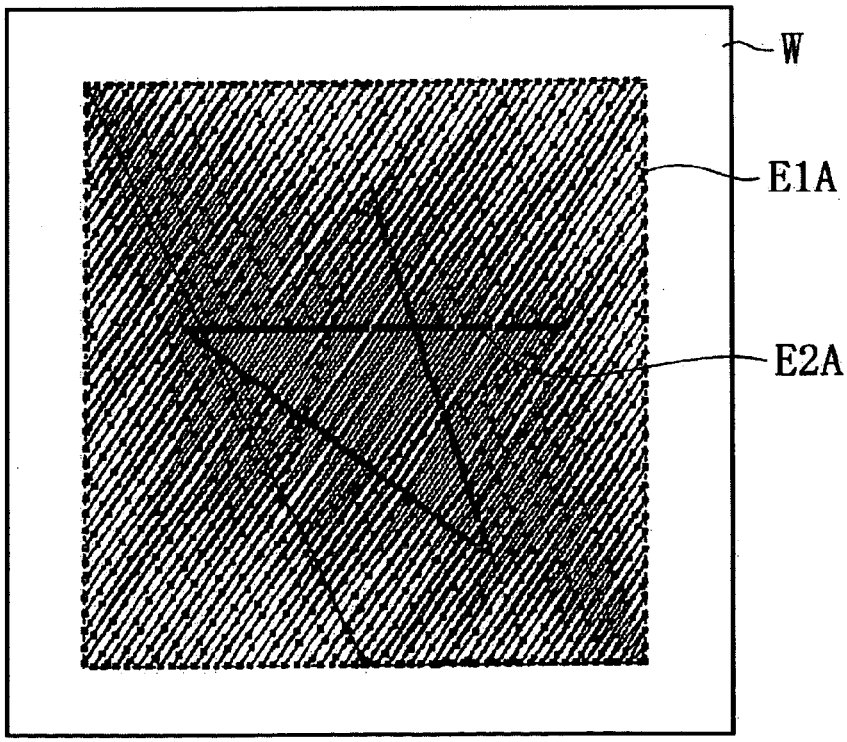
FIG. 10 is a plan view of cloth embroidered such that a stamp pattern "star" is raised relative to a base area.

A square, first embroidery area E1A is set. A "star" is set as a second embroidery area E2A. The stitch type of the first embroidery area E1A is set, for example, to tatami stitches. "Raised" texture is set as raised/recessed texture information. The stitch forming direction that is a sewing parameter is set to "raised to the right". As shown in FIG. 10, "satin stitches" of the second area E2A is different from "tatami stitches" of the first area E1A. Therefore, the "star" of the second area E2A can be expressed more conspicuously than the first area E1A and raised relative to the first area E1A in a three-dimensional manner.

Figure 11:
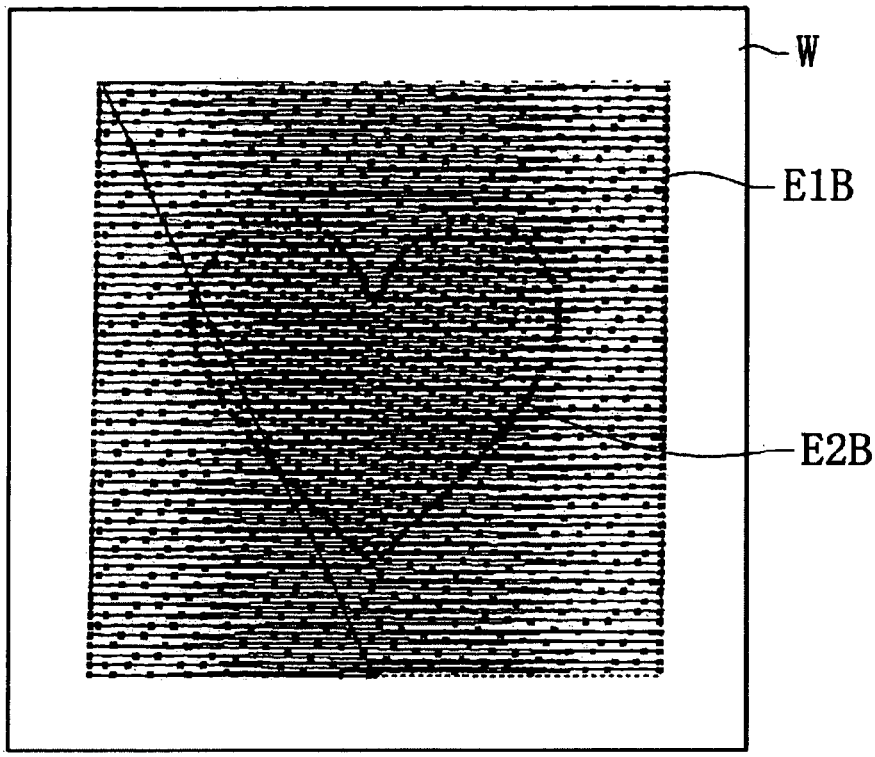
FIG. 11 is a plan view of cloth embroidered such that a stamp pattern "heart" is recessed relative to a base area.

In addition, a square, first embroidery area E1B is set. A "heart" is set as a second embroidery area E2B. The stitch type of the first area E1B is set, for example, to tatami stitches. "Recessed" texture is set as raised/recessed texture information. The stitch forming direction that is a sewing parameter is set to "horizontal". In this case, the stitch type of the second area E2B is set to "tatami 1" having a needle drop point pitch smaller than that of the "tatami stitches" of the first area E1B, based on the first stitch type setting table. Therefore, as shown in FIG. 11, the "tatami stitches" of the second area E2B is different from the "tatami stitches" of the first area E1B. Therefore, the "heart" of the second area E2B can be expressed more conspicuously than the first area E1B and recessed relative to the first area E1B in a three-dimensional manner.

Figure 12:
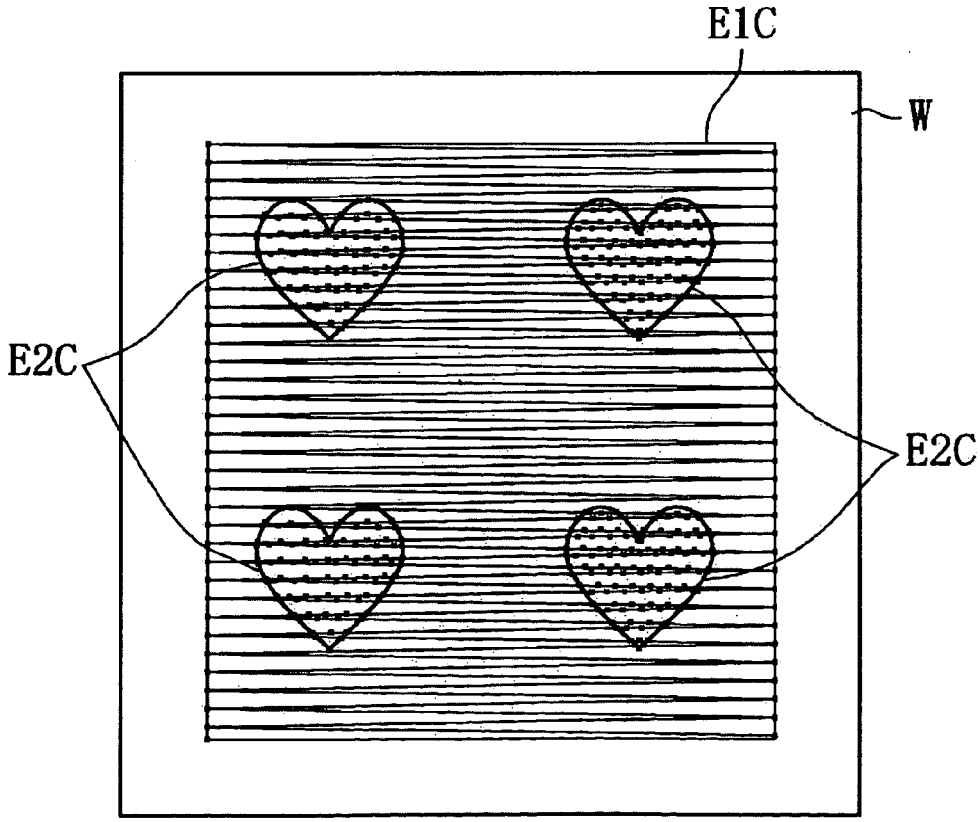
FIG. 12 is a plan view of cloth embroidered such that plural second embroidery areas are recessed relative to a base area.

Referring to FIG. 12, a square, first embroidery area E1C is set. Plural overlapping "hearts" are set as second embroidery areas E2C. The stitch type of the first area E1C is set, for example, to "satin stitches". "Recessed" texture is set as the raised/recessed texture information. The stitch forming direction that is a sewing parameter is set to "horizontal". In this case, the plural second areas E2C are all set to the same stitch type "tatami stitches" and so the plural second areas E2C can be made uniform in stitch type. In addition, the stitches in the second areas can be expressed more conspicuously than the stitches in the first area E1C and recessed relative to the first area in a three-dimensional manner.

Figure 13:
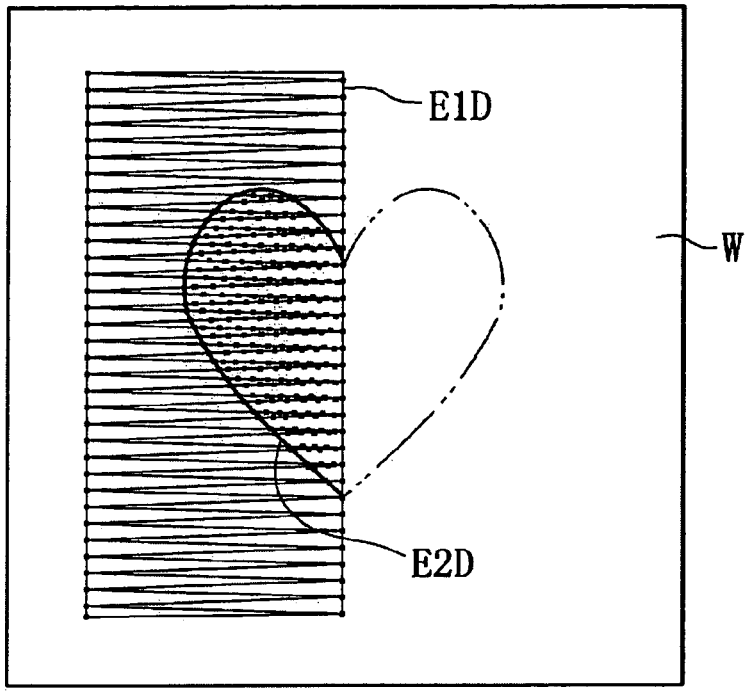
FIG. 13 is a plan view of cloth embroidered such that a second embroidery area partially overlapping with a first embroidery area is recessed.

As shown in FIG. 13, a rectangular, first embroidery area E1D is set. A heart-shaped, second embroidery area E2D is set such that only its left half is overlapped on the first area. The stitch type of the first area E1D is set, for example, to satin stitches. The raised/recessed texture information is set to "recessed" texture. The stitch forming direction that is a sewing parameter is set to "horizontal". In this case, embroidery data about only the left half of the heart-shaped area overlapped on the first area E1D is produced by the control of the calculations of needle drop points in the block. No embroidery data is produced about the portion located outside the first area E1D. Therefore, embroidery data only about the necessary embroidery area can be produced in such a way that the second area E2D does not extend beyond the first area E1D.

As described so far, the program for controlling production of embroidery data to cause any one of various kinds of computers acting as the embroidery data producing device 10 to provide control of production of embroidery data includes the area information input routine (S11-S12), first setting routine (S13), second setting routine (S14), and embroidery data producing routine (S16). The same advantages as the advantages produced by the above-described embodiment can be obtained by performing control of production of embroidery data by the use of the embroidery data production controlling program including these area information input routine, first setting routine, second setting routine, and embroidery data production routine.

Figure 14:
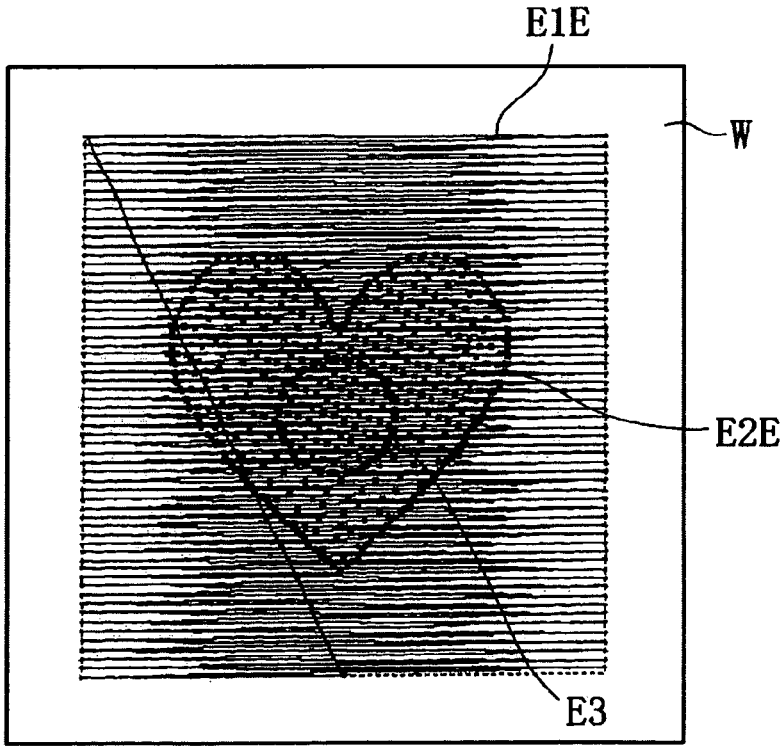
FIG. 14 is a plan view of cloth embroidered such that first, second, and third embroidery areas overlap each other and are recessed relative to each other.
Figure 15:
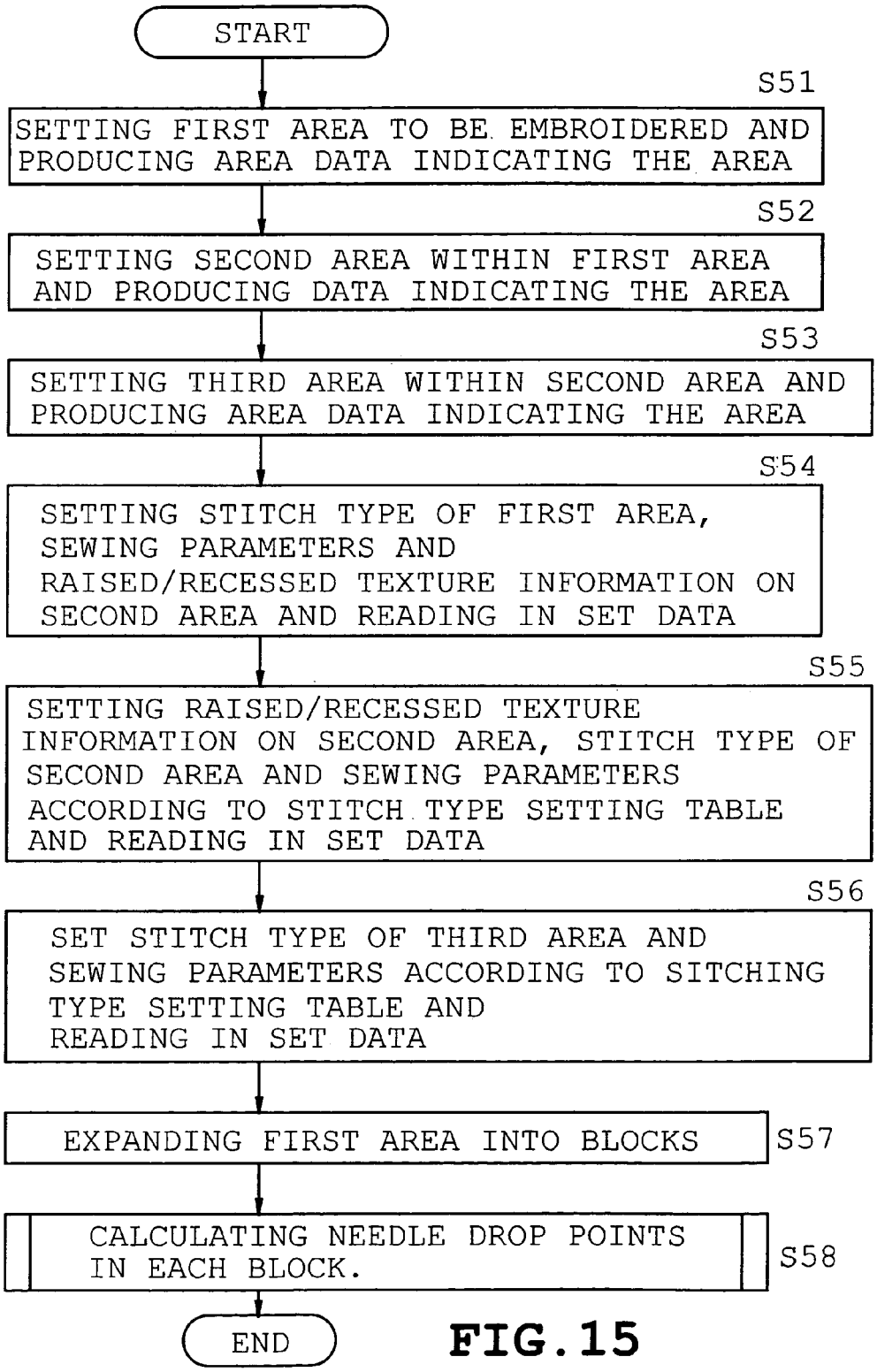
FIG. 15 is a flowchart illustrating a modified embodiment of the disclosure, corresponding to FIG. 5.

A modification of the above-described embodiment is next described. The stitch type of the third embroidery area is additively stored in the first stitch type setting table shown in FIG. 3. As shown in FIG. 14, a heart-shaped, second embroidery area E2E is set to overlap the first area E1E. Furthermore, a circular, third embroidered area E3 is set to overlap the second area E2E. A sequence of operations performed in this way is described by referring to the flowchart of FIG. 15.

First, data about the first embroidery area E1 is set in the same way as in the step S11 (S51). Data about the second embroidery area E2 is set in the same way as in the step S12 (S52) Data about the third embroidery area E3 is set (S53).

The stitch type of the first embroidery area E1 is then set in the same way as in the step S13 (S54). The stitch type of the second embroidery area E2 is automatically set in the same way as in the step S14 (S55). Furthermore, the stitch type of the third embroidery area E3 is automatically set according to the first stitch type setting table (S56). Step S57 is carried out in the same way as the step S15. Then, needle drop points are calculated for the third embroidery area E3, as well as for the first and second embroidery areas E1 and E2 (S58).

Finally, first embroidery data for embroidering the first area E1 except for its part on which the second area E2 is overlapped, second embroidery data for embroidering the second area E2 except for its part on which the third area E3 is overlapped, and third embroidery data for embroidering the third area E3 are produced. Thus, this sequence of control operations is ended.

For example, as shown in FIG. 14, a square, first embroidery area E1E is set. A heart-shaped, second embroidery area E2E is set to overlap the first area E1E. A circular, third embroidery area E3 is set to overlap the second area E2E. The stitch type of the first area E1E is set, for example, to satin stitches. The raised/recessed texture information is set to "recessed" texture. The stitch forming direction that is a sewing parameter is set to "horizontal".

In this case, as shown in FIG. 14, the "tatami stitches" of the second embroidery area E2E is different from the "satin stitches" of the first embroidery area E1E. Therefore, the heart-shaped second area E2E can be expressed more conspicuously than the first area E1E and recessed relative to the first area in a three-dimensional manner. The needle drop point pitch of the "tatami stitches" of the circular third area E3E is smaller than the needle drop point pitch of the "tatami stitches" of the second area E2E. Therefore, the circular third area E3E can be expressed more conspicuously than the second area E2E and recessed relative to the second area E2E in a three-dimensional manner.

In the first stitch type setting table shown in FIG. 3, the raised/recessed texture information about the third embroidery area E3 relative to the second area E2 may be set separately.

Moreover, embroidery areas with previously set various kinds of figures and patterns may be read into the hard disk 25 of the embroidery data producing device 10. In addition, embroidery areas with various figures and patterns may be accepted by the image scanner 15 and set in the first through third embroidery areas.

When the stitch type of the first embroidery area E1 is set manually, the stitch types of the second embroidery area E2 and third embroidery area E3 are automatically set. These stitch types may be modified, for example, on the display device 12.

Furthermore, when the stitch type of the second embroidery area E2 is set manually, the stitch type of the first embroidery area E1 may be set automatically.

Additionally, a manual setting mode may be provided to permit the stitch types of the first embroidery area E1 and second embroidery area E2 to be set manually.

In the above embodiments, the operator sets the raised/recessed texture information to determine whether the stitches to be formed in the second embroidery area E2 is raised or recessed relative to the stitches to be formed in the first embroidery area El. Then, the stitch type of the second area E2 is automatically set. Alternatively, the second embroidery area E2 may be automatically set to a stitch type different from the stitch type set for the first embroidery area E1; the operator does not set the raised/recessed texture information.

In this case, if the stitch type set for the first embroidery area E1 is "satin stitches", the second embroidery area E2 is automatically set to "tatami stitches". If the stitch type set for the first embroidery area E1 is "tatami stitches", the second embroidery area E2 is automatically set to "satin stitches".

The stitch forming direction in the each aforementioned embroidery area will be complemented as follows. On one hand, when (1) a stitch type for each of the first and second embroidery areas E1 and E2 is set to the "tatami stitches" (or "parallel tatami stitches") in which stitches formed by both forward sewing and return sewing are parallel to each other, and (2) a horizontal stitch forming direction for each of the first and second embroidery areas E1 and E2 is set, stitches formed in both embroidery areas extend horizontally (parallel tatami stitches) and have respective stitch forming directions coincident with each other.

On the other hand, stitch types for the first and second embroidery areas E1 and E2 are sometimes set to different stitch types, for example, one to the "tatami stitches" and the other to the "satin stitches." Furthermore, stitch types for both embroidery areas are sometimes set to the same "tatami stitches" in which stitches formed by both forward sewing and return sewing are at an angle with each other (V-shaped tatami stitches). In each of the aforesaid cases, stitch forming directions in both embroidery areas are not sometimes coincident with each other. In this case, stitch angles or angles made by stitches of the forward sewing and return sewing are caused to agree with each other or traveling directions of stitch rows in both embroidery areas are caused to agree with each other, whereupon embroidering directions in which stitch lines are in a row (namely, directions generally perpendicular to the stitch forming directions) can be substantially coincident with each other.

The foregoing description and drawings are merely illustrative of the principles of the disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. An embroidery data producing device for producing embroidery data for embroidering by an embroidery sewing machine, the embroidery data producing device comprising:

area information input means for inputting area information indicating first and second areas, the first area including a first embroidery area and an overlap area, the second area including a second embroidery area that overlaps the first area at the overlap area;

first setting means for setting a first stitch type, for a stitch to be made using a thread, for one of the first and second embroidery areas;

second setting means for setting a second stitch type, which is different from the first stitch type but is for the same thread as the first stitch type, for the other embroidery area than the embroidery area set by the first setting means; and embroidery data producing means for producing first and second embroidery data based on the stitch types set by the first and second setting means, respectively, the first embroidery data being produced to embroider the first embroidery area of the first area but not to embroider the overlap area, the second embroidery data being produced to embroider the second embroidery area.

2. The embroidery data producing device according to claim 1, wherein the one area is the first area, while the other area is the second area.

3. The embroidery data producing device according to claim 2, wherein the first setting means is manual setting means for setting the stitch type manually, and wherein the second setting means automatically sets the second stitch type different from the first stitch type set by the first setting means.

4. The embroidery data producing device according to claim 1, wherein when the first setting means has set a stitch type for the one area to satin stitches, the second setting means sets a stitch type for the other area to tatami stitches.

5. The embroidery data producing device according to claim 1, wherein when the first setting means has set a stitch type for the one area to tatami stitches, the second setting means sets a stitch type for the other area to satin stitches.

6. The embroidery data producing device according to claim 1, wherein the stitch types set by the first and second setting means include data about at least one of needle drop point pitch and needle drop point deviation amount.

7. The embroidery data producing device according to claim 1, wherein the embroidery data producing means produces embroidery data only about a part of the second area overlapped on the first area and does not produce embroidery data about a part of the second area that is located outside the first area.

8. The embroidery data producing device according to claim 3, further comprising raised/recessed texture information-specifying means for specifying whether stitches to be formed in the other area is raised or recessed relative to stitches to be formed in the one area, and wherein the second setting means sets a stitch type of the other area based on the stitch type set by the first setting means and on the raised/recessed texture information specified by the raised/recessed texture information-specifying means.

9. The embroidery data producing device according to claim 1, wherein the embroidery data producing means produces the embroidery data such that a stitch forming direction in which the first area is embroidered is a same as a stitch forming direction in which the second area is embroidered.

10. The embroidery data producing device according to claim 1, wherein the embroidery data producing means produces embroidery data to form needle drop points on an outline of the second area.

11. The embroidery data producing device according to claim 2, wherein the area information input means is capable of inputting information indicating plural second areas to be embroidered, and wherein the second setting means collectively sets the same stitch type for all the second areas.

12. The embroidery data producing device according to claim 1, wherein the area information input means is capable of inputting information indicating a third area to be embroidered inside the second area, at least a part of the third area being overlapped on the second area, the embroidery data producing device further comprising third setting means for setting a stitch type different from the stitch type set by the second setting means for the third area, and the embroidery data producing means produces third embroidery data for embroidering the third area based on the stitch type set by the third setting means.

13. A program stored in a computer-readable medium for controlling production of embroidery data, the program being adapted to cause a computer incorporated in an embroidery data producing device to control the production of the embroidery data to be used to perform embroidery by an embroidery sewing machine, the program comprising:

an area information input routine for inputting area information indicative of first and second areas, the first area including a first embroidery area and an overlap area, the second area including a second embroidery area that overlaps the first area at the overlap area;

a first setting routine for reading in data to be used to set a first stitch type, for a stitch to be made using a thread, for one of the first and second embroidery areas;

a second setting routine for reading in data to be used to set a second stitch type, which is different from the first stitch type but is for the same thread as the first stitch type, for the other embroidery area than the embroidery area set by the first setting routine; and an embroidery data producing routine for producing first and second embroidery data based on the stitch types set by the first and second setting routines, the first embroidery data being produced to embroider the first embroidery area of the first area but not to embroider the overlap area, the second embroidery data being produced to embroider the second embroidery area.

14. The controlling program according to claim 13, wherein the first setting routine reads in data about a manually set stitch type, and the second setting routine automatically sets a stitch type different from the stitch type set by the first setting routine.

15. The controlling program according to claim 13, wherein when a stitch type for the one area is set to satin stitches by the first setting routine, the second setting routine sets a stitch type for the other area to tatami stitches.

16. The controlling program according to claim 13, wherein when a stitch type for the one area is set to tatami stitches by the first setting routine, the second setting routine sets a stitch type for the other area to satin stitches.

17. The controlling program according to claim 13, wherein the stitch types set by the first and second setting routines include data about at least one of needle drop point pitch and needle drop point deviation amount.

18. The controlling program according to claim 13, wherein the embroidery data producing routine produces embroidery data only about a part of the second area overlapped on the first area and does not produce embroidery data about a part of the second area that is located outside the first area.

19. The controlling program according to claim 13, further comprising a raised/recessed texture information-specifying routine for specifying whether stitches to be formed in the other area is raised or recessed relative to stitches to be formed in the one area, wherein the second setting routine sets a stitch type for the other area based on the stitch type set by the first setting routine and on the raised/recessed texture information specified by the raised/recessed texture information-specifying routine.

20. The controlling program according to claim 13, wherein the embroidery data producing routine produces the embroidery data such that a stitch forming direction in which the first area is embroidered is a same as a stitch forming direction in which the second area is embroidered.

21. The controlling program according to claim 13, wherein the embroidery data producing routine produces embroidery data to form needle drop points on an outline of the second area.

22. The controlling program according to claim 13, wherein the area information input routine is capable of inputting information indicating plural second areas to be embroidered, and the second setting routine collectively sets to the same stitch type for all the second areas.

23. The controlling program according to claim 13, wherein the area information input routine is capable of inputting information indicating a third area to be embroidered inside the second area, at least a part of the third area being overlapped on the second area, the controlling program further comprising a third setting routine for setting a stitch type different from the stitch type set by the second setting routine for the third area, and the embroidery data producing routine produces third embroidery data for embroidering the third area based on the stitch type set by the third setting routine.

* * * * *